US009086668B2

(12) United States Patent
Nakamura

(10) Patent No.: US 9,086,668 B2
(45) Date of Patent: Jul. 21, 2015

(54) IMAGE FORMING SYSTEM AND POST-PROCESSING DEVICE WITH SHEET SIZE ACQUISITION

(71) Applicant: KONICA MINOLTA, INC., Tokyo (JP)

(72) Inventor: Shoichi Nakamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 88 days.

(21) Appl. No.: 13/940,965

(22) Filed: Jul. 12, 2013

(65) Prior Publication Data

US 2014/0044468 A1 Feb. 13, 2014

(30) Foreign Application Priority Data

Aug. 10, 2012 (JP) ..... 2012-177890

(51) Int. Cl.
*B65H 37/04* (2006.01)
*G03G 15/00* (2006.01)

(52) U.S. Cl.
CPC ..... *G03G 15/6582* (2013.01)

(58) Field of Classification Search
CPC ..... B65H 37/04
USPC ..... 270/58.07, 58.08, 58.09, 32, 37, 45; 399/410
See application file for complete search history.

(56) References Cited

U.S. PATENT DOCUMENTS

2007/0057426 A1* 3/2007 Tao et al. ..... 270/58.09
2011/0266737 A1* 11/2011 Chowdry et al. ..... 270/21.1
2012/0153555 A1* 6/2012 Akashi ..... 270/45

FOREIGN PATENT DOCUMENTS

JP 2007-086568 A 4/2007
JP 2008133124 A * 6/2008
JP 2009073602 A * 4/2009
JP 2011112763 A * 6/2011
JP 2012126502 A * 7/2012

OTHER PUBLICATIONS

Japanese Office Action dated Oct. 22, 2014, issued in counterpart Japanese Application No. 2012-177890.

* cited by examiner

*Primary Examiner* — Patrick Mackey
(74) *Attorney, Agent, or Firm* — Holtz, Holtz, Goodman & Chick PC

(57) ABSTRACT

Provided is an image forming system including a feed tray, a printer unit, a first post-processing unit that performs first post-processing accompanying at least a change in a sheet size, a second post-processing unit that performs second post-processing other than the first post-processing, and a control unit that controls setting and performing feeding, outputting, and the post-processing of the sheet. In a case where the first post-processing and the second post-processing are set, the control unit acquires a feeding sheet size of a sheet fed from the feed tray, calculates a sheet size after the first post-processing based on the acquired feeding sheet size, and determines whether the set post-processings can be performed based on the calculated sheet size and a sheet size that can be processed by the second post-processing.

18 Claims, 10 Drawing Sheets

IMAGE FORMING SYSTEM AND POST-PROCESSING DEVICE WITH SHEET SIZE ACQUISITION

BACKGROUND OF THE INVENTION

1. Field of the Invention

The present invention relates to an image forming system capable of performing printing in which an image is formed on a sheet, and the sheet is output and performing a plurality of post-processings for the printed sheet as desired and a post-processing method.

2. Description of the Related Art

In image forming apparatuses in which an image is printed on a sheet, such as copying machines, printers, facsimile, and multi-function machines, desired post-processing can be performed for a sheet on which an image is printed. Generally, post-processing is performed by a post-processing apparatus that is connected to the rear stage of an image forming apparatus. As post-processing apparatuses, for example, there are a side stitching apparatus, a saddle stitching apparatus, a folding apparatus, a punching apparatus, a binding apparatus, a stapling apparatus, and a cut-processing apparatus.

In an image forming system configured by at least an image forming apparatus and a post-processing apparatus as above, printing and post-processing are performed, for example, based on a job set by the image forming apparatus side. In the setting of a job, the size, the weight, and the paper type of a sheet and the content of post-processing, and the like can be set. In addition, in a case where a plurality of post-processing units are included, a plurality of post-processings can be set.

Meanwhile there is a restriction on the size of a sheet that can be processed by each post-processing unit. Thus, when the post-processing is set, it is determined whether a sheet fed from a feed tray has a sheet size for which post-processing can be performed before printing, printing is permitted only in a case where the sheet has a sheet size for which the post-processing can be performed, and printing is not permitted in a case where the sheet has a sheet size for which post-processing cannot be performed (for example, see Japanese Unexamined Patent Application Publication No. 2007-86568).

In addition, in Japanese Unexamined Patent Application Publication No. 2007-86568, it has also been proposed that, in a case where the length of one side of a sheet housed in the feed tray for which post-processing is performed is not permitted for the post-processing, the other side is checked, and, in a case where the other side is permitted for the post-processing, an error message is not displayed, whereby the error is automatically resolved, and the operability is improved.

In addition, there are post-processing apparatuses each including a slitter which cuts a sheet. In an image forming system including such a post-processing apparatus, in a case where another post-processing is performed using a post-processing apparatus connected to the downstream side of the slitter, a sheet is cut by the slitter, and accordingly, there is a problem in that it cannot be correctly determined whether the post-processing can be performed based on information of the sheet size set in the feed tray. When an incorrect determination is made, there is concern that a sheet for which the post-processing cannot be performed is fed so as to cause the occurrence of a jam in a post-processing unit, or a job is not correctly performed.

The present invention have an object to providing an image forming system and a post-processing method capable of correctly determining whether to perform post-processing even in a case where post-processing in which the size of a sheet changes due to cutting of the sheet or the like is included.

SUMMARY OF THE INVENTION

To achieve at least one of the abovementioned objects, an image forming system reflecting one aspect of the present invention comprises: a feed tray to feed a housed sheet; a printer unit to form an image on the sheet and outputs the sheet; a first post-processing unit to perform first post-processing accompanying at least a change in a sheet size and a second post-processing unit to perform second post-processing other than the first post-processing, which are post-processing units performing post-processing for the sheet on which the image is formed; and a control unit that controls setting and performing feeding, outputting, and the post-processing of the sheet, wherein, in a case where the first post-processing and the second post-processing are set, the control unit performs post-processing determining in which a feeding sheet size of a sheet fed from the feed tray is acquired, a sheet size after the first post-processing is calculated based on the acquired feeding sheet size, and it is determined whether the set post-processings can be performed based on the calculated sheet size and a sheet size that can be processed by the second post-processing.

In the above-described image forming system, it is preferable that the control unit determine order of the second post-processing and the first post-processing in the set post-processings, apply the feeding sheet size as a sheet size of a sheet that is a target for the second post-processing in a case where the second post-processing is performed before the first post-processing, and apply the sheet size after the first post-processing as the sheet size of the sheet that is a target for the second post-processing in a case where the second post-processing is performed after the first post-processing.

In the above-described image forming system, it is preferable that the control unit determine whether the post-processings can be processed based on whether the second post-processing and the first post-processing are compatible or whether the first post-processing unit and the second post-processing unit can be operated.

In the above-described image forming system, it is preferable that, in a case where the sheet that is a target for the second post-processing in the setting of the post-processing is a sheet after the first post-processing, the control unit compares the calculated sheet size and the sheet size that can be processed in the second post-processing with each other, and performs the post-processing determining based on a comparison result.

In the above-described image forming system, it is preferable that the first post-processing unit changes the sheet size by performing a cutting process of a target sheet in at least one direction of a primary scanning direction and a sub-scanning direction as the first post-processing and discharges the sheet to a downstream.

In the above-described image forming system, it is preferable that, in a case where it is determined that the processing cannot be performed in the post-processing determining, the control unit enables a change of the setting of the outputting and performs the post-processing determining again based on a changed setting when the setting is changed.

In the above-described image forming system, it is preferable that, in a case where it is determined that the post-processings cannot be performed in the post-processing determining, the control unit performs a print start prohibiting process.

To achieve at least one of the abovementioned objects, a post-processing method for performing post-processing reflecting another aspect of the present invention for a sheet on which an image is formed, the post-processing method comprises: performing post-processing determining in which a feeding sheet size of a sheet for the post-processing is acquired, a sheet size after first post-processing is calculated based on the acquired feeding sheet size, and it is determined whether the first post-processing and second post-processing can be performed based on the calculated sheet size and a sheet size that can be processed by the second post-processing in a case where at least the first post-processing accompanying a change in the sheet size and the second post-processing other than the first post-processing are performed.

In the above-described post-processing method, it is preferable that order of the first post-processing and the second post-processing be determined, the feeding sheet size be applied as a sheet size of a sheet that is a target for the second post-processing in a case where the second post-processing is performed before the first post-processing, and the sheet size after the first post-processing be applied as the sheet size of the sheet that is a target for the second post-processing in a case where the second post-processing is performed after the first post-processing.

In the above-described post-processing method, it is preferable that it be determined whether the post-processings can be processed in the post-processing determining based on whether the second post-processing and the first post-processing are compatible or whether the first post-processing and the second post-processing can be operated.

In the above-described post-processing method, it is preferable that, in a case where the sheet that is a target for the second post-processing is a sheet after the first post-processing, the calculated sheet size and the sheet size that can be processed in the second post-processing be compared with each other, and the post-processing determining be performed based on a comparison result.

In the above-described post-processing method, it is preferable that, in the first post-processing, the sheet size change by performing a cutting process of a target sheet in at least one direction of a primary scanning direction and a sub-scanning direction, and the sheet be discharged to a downstream.

In the above-described post-processing method, it is preferable that, in a case where it is determined that the processing cannot be performed in the post-processing determining, when the setting of the outputting is changed, the post-processing determining be performed again based on the changed setting.

In the above-described post-processing method, it is preferable that the change of the setting of the outputting is a change of the setting of the post-processings and/or a change of the feeding sheet size.

In the above-described post-processing method, it is preferable that, in the first post-processing, the sheet size is changed by performing a cutting process of a target sheet in at least one direction of the a scanning direction and a sub-scanning direction and, the sheet is discharged to a downstream, and wherein a setting of a cutting amount of the cutting process is changeable.

DETAILED DESCRIPTION OF THE PREFERRED EMBODIMENTS

Hereinafter, an image forming system according to an embodiment of the present invention will be described with reference to the accompanying drawings.

Figure 1:
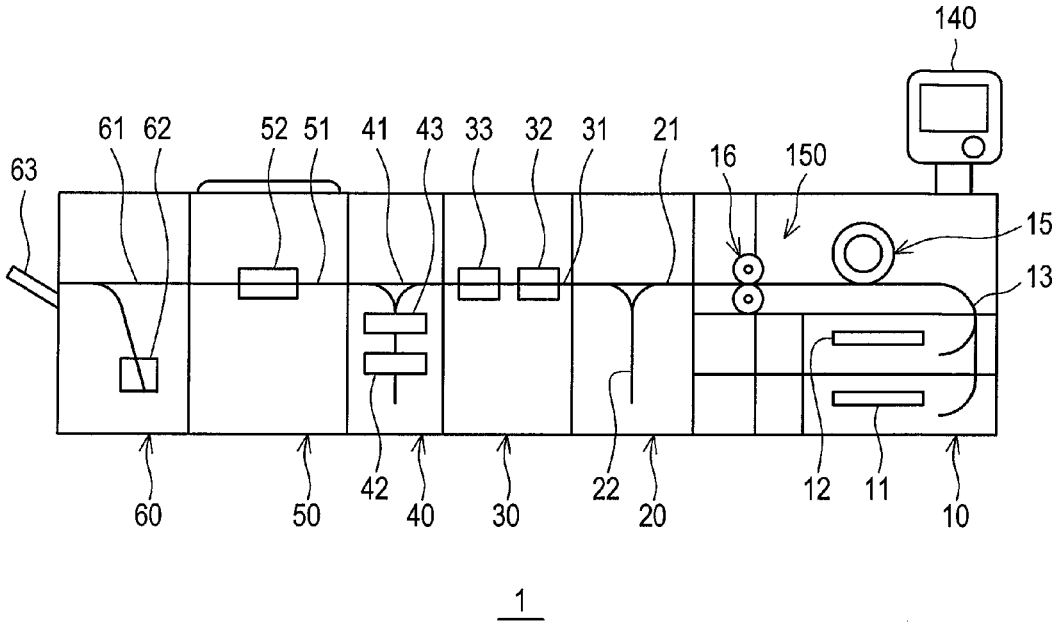
FIG. 1 is a schematic diagram that illustrates the entirety of an image forming system according to an embodiment of the present invention.

FIG. 1 illustrates the entirety of an image forming system 1. Sequentially from the front side, an image forming apparatus 10, a reverse conveyance apparatus 20, a folding and punching apparatus 30, a slit apparatus 40, a saddle stitching apparatus 50, and a side stitching apparatus 60 are connected. Apparatuses other than the image forming apparatus 10 and the reverse conveyance apparatus 20 correspond to post-processing apparatuses. The slit apparatus 40 includes a first post-processing unit, and the reverse conveyance apparatus 20, the folding and punching apparatus 30, the saddle stitching apparatus 50, and the side stitching apparatus 60 include second post-processing units.

In other words, in the present invention, the number of the first post-processing units and the second post-processing units is not particularly limited but may be one or two or more.

Hereinafter, each apparatus will be described.

The image forming apparatus 10 includes feed trays 11 and 12 in a lower part of the main body, and a sheet conveying unit 13 extends to the downstream side so as to be connected to the feed trays 11 and 12.

Near the midway of the sheet conveying unit 13, an image forming unit 15 is arranged, and an image is formed on a sheet, which is conveyed by the sheet conveying unit 13, by the image forming unit 15. A fixing device 16 is arranged near the midway of the sheet conveying unit 13 on the downstream side of the image forming unit 15. The fixing device 16 fixes the image formed on the sheet by applying heat thereto.

In addition, in an upper part outside the main body of the image forming apparatus 10, an operating unit 140 receiving an operator's operating input is disposed. The operating unit 140 can display information and serves also as a display unit. Here, the operating unit and the display unit may be separately disposed. By using the operating unit 140, various operating inputs can be made, and a job setting including a setting of post-processing and the like can be performed. In addition, by using the operating unit 140, various kinds of information and notifications can be displayed, and an error message or the like can be displayed in a case where post-processing cannot be performed.

The sheet conveying unit 13 is connected to a sheet conveying unit 21 of the reverse conveyance apparatus 20 on the downstream side.

In the reverse conveyance apparatus 20, the sheet conveying unit 21 that is connected to the sheet conveying unit 13 of the image forming apparatus 10 on the upstream side, and is connected to the folding and punching apparatus 30 on the downstream side is disposed. In the midway of the sheet conveying unit 21, a reverse unit 22 is disposed, and a sheet conveyed by the sheet conveying unit 21 can be reversed in the reverse unit 22 and be conveyed to the downstream side of the sheet conveying unit 21. The reverse conveyance apparatus 20 can selectively perform any one of straight conveyance and reverse conveyance.

In the folding and punching apparatus 30, a sheet conveying unit 31 that is connected to the sheet conveying unit 21 of the reverse conveyance apparatus 20 on the upstream side and is connected to the slit apparatus 40 on the downstream side is disposed.

In the midway of the sheet conveying unit 31, a folding unit 32 that performs a folding process for a sheet and a punching unit 33 that performs punching process for a sheet are disposed. A sheet for which the folding process has been performed by the folding unit 32 and/or the punching process has been performed by the punching unit 33 is conveyed to the slit apparatus 40 disposed on the downstream side through the sheet conveying unit 31. Each one of the folding unit 32 and the punching unit 33 is one of the second post-processing units according to the present invention, and each one of the folding process and the punching process is one of the second post-processings according to the present invention. The folding and punching apparatus 30 may selectively perform any one of sheet discharging without any post-processing, sheet discharging with a folding process, sheet discharging with a punching process, sheet discharging with folding and punching processes.

In the slit apparatus 40, a sheet conveying unit 41 that is connected to the sheet conveying unit 31 of the folding and punching apparatus 30 on the upstream side and is connected to the saddle stitching apparatus 50 on the downstream side is disposed.

In the midway of the sheet conveying unit 41, a creasing unit 42 that performs a creasing process, which is used for cutting, of a sheet and a slitter unit 43 that cuts top and bottom portions of a sheet are disposed. For a sheet conveyed by the sheet conveying unit 41, after the creasing process is performed by the creasing unit 42, a process of cutting the top and bottom portions of the sheet aiming at the creased portions is performed. The cutting is performed in accordance with a set cutting amount. The cut sheet is conveyed to the saddle stitching apparatus 50 through the sheet conveying unit 41.

Both the creasing unit 42 and the slitter unit 43 form a set and configure a first post-processing unit, and the creasing process and the cutting of the top and bottom portions correspond to the first post-processing. The slit apparatus 40 can selectively perform any one of sheet discharging without any cutting process and sheet discharging after a cutting process.

In the saddle stitching apparatus 50, a sheet conveying unit 51 that is connected to the sheet conveying unit 41 of the slit apparatus 40 on the upstream side and is connected to the side stitching apparatus 60 on the downstream side is disposed. In the midway of the sheet conveying unit 51, a center folding unit 52 is disposed, and the saddle stitching apparatus 50 can selectively perform any one of sheet discharging without any saddle stitching and sheet discharging with saddle stitching. The center folding unit 52 is one of the second post-processing units, and the saddle stitching is one of the second post-processings.

In the side stitching apparatus 60, a sheet conveying unit 61 that is connected to the sheet conveying unit 51 of the saddle stitching apparatus 50 on the upstream side and is connected to a sheet discharging tray 63 on the downstream side is disposed. In the midway of the sheet conveying unit 61, a stapling unit 62 that staples sheets is disposed. The side stitching apparatus 60 can selectively perform any one of sheet discharging without any stapling and sheet discharging after stapling. The sheet is discharged to the sheet discharging tray 63. The stapling unit 62 is one of the second post-processing units, and the stapling is one of the second post-processings.

Next, a control block of the image forming system will be described with reference to FIG. 2.

Figure 2:
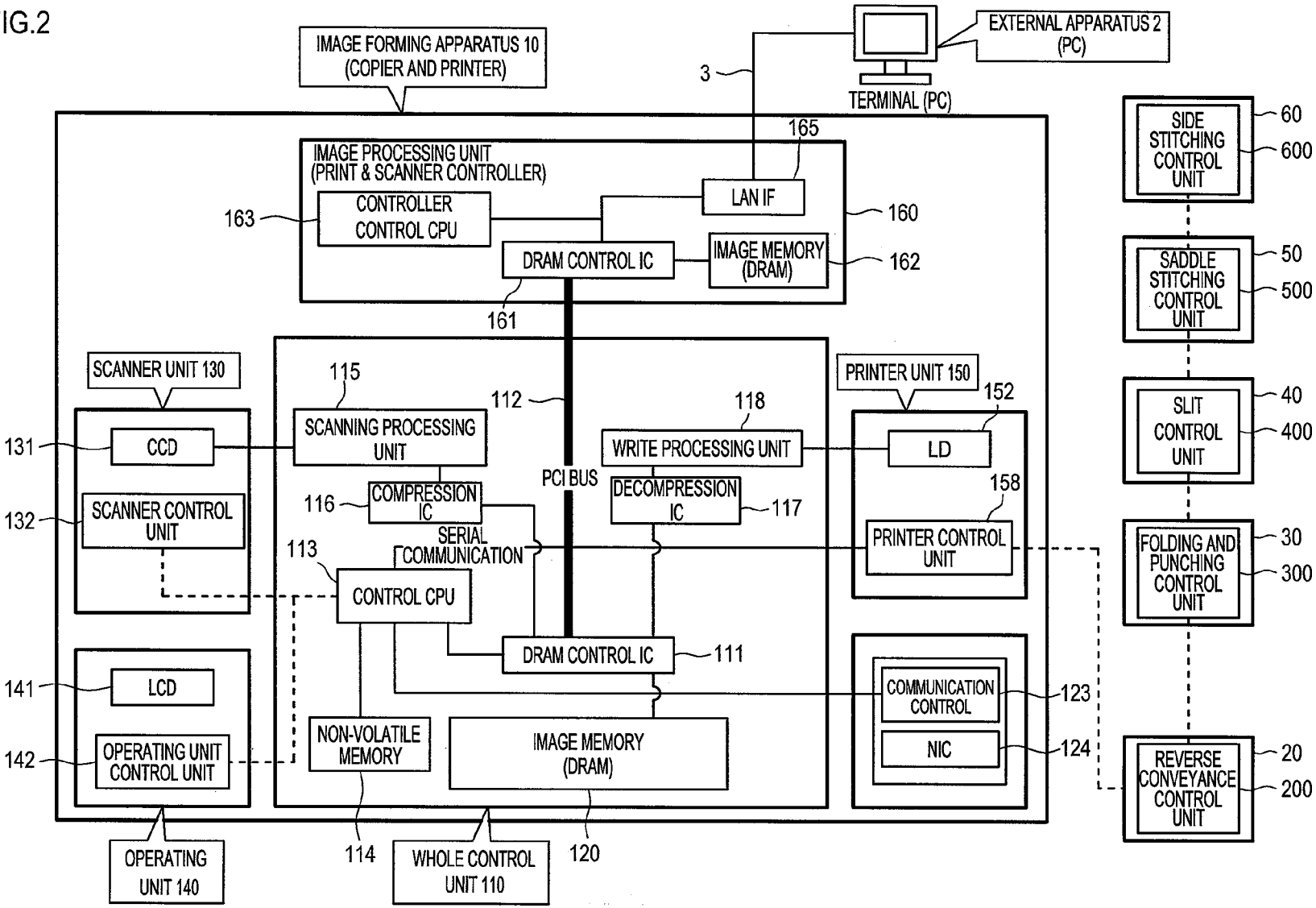
FIG. 2 illustrates a control block diagram of the image forming system.

FIG. 2 illustrates connections between a control block of the image forming apparatus 10 that is a digital multi-function device (a copier, a printer, and a scanner), control blocks of the reverse conveyance apparatus 20, the folding and punching apparatus 30, the slit apparatus 40, the saddle stitching apparatus 50, and the side stitching apparatus 60, and an external apparatus (PC) 2 that is a terminal (PC) and is a block diagram of the entire image forming system 1. The content thereof will be described in detail as below.

The image forming apparatus 10 includes a whole control unit 110, a scanner unit 130, the operating unit 140, and a printer unit 150 and includes an image processing unit (printer & scanner controller) 160 that processes image data input from an external apparatus (PC) 2 such as a terminal PC through a LAN 3 or enables image data acquired by the scanner unit 130 to be transmitted to the external apparatus (PC) 2 through the LAN 3.

The whole control unit 110 includes a PCI bus 112 that is connected to the image processing unit (print & scanner controller) 160, and a DRAM control IC 111 is connected to the PCI bus 112. An image memory (DRAM) 120 is connected to a DRAM control IC 111. The image memory (DRAM) 120 includes a compression memory used for storing compressed image data and a page memory used for temporarily storing non-compressed image data that is a printing target before the formation of an image.

In addition, the whole control unit 110 includes a control CPU 113 and the DRAM control IC 111 is connected to the control CPU 113.

Furthermore, a non-volatile memory 114 configured by a flash memory or the like is connected to the control CPU 113. In the non-volatile memory 114, initial print setting information of the image forming apparatus 10, mechanical setting information such as process control parameters, setting values set by a user, initial data of output settings, a program used for operating the control CPU 113, and the like are stored.

The control CPU 113 can read non-volatile data of the non-volatile memory 114 and can write desired data into the non-volatile memory 114.

The control CPU 113 controls the operation of each unit of the image forming apparatus 10 in accordance with the mechanical setting information, the print setting information, the output settings, and the like.

The control CPU 113 configures a control unit according to the present invention together with the non-volatile memory 114 and the like and can control the entire image forming system 1.

The control CPU 113 can acquire the size of sheets (feeding sheet size) housed in the feed tray. The feeding sheet size is acquired based on a tray setting including sheet information set by the control CPU 113 and the like. In addition, the control CPU 113 can perform an output setting of a job including settings of the post-processing and the like through the operating unit 140.

In addition, by using the control CPU 113, as one of the settings of the post-processing, the amount of cutting performed in the slit apparatus 40 can be set, and a sheet size after cutting can be calculated based on the sheet size of sheets housed in the feed tray and the amount of cutting.

Furthermore, the control CPU 113 can perform post-processing determining in which it is determined whether post-processing can be performed based on the feeding sheet size, the calculated sheet size, and a sheet size for which the second post-processing can be performed. It can be determined whether the post-processing can be performed based on whether the first post-processing and the second post-processing are compatible with each other, whether post-processing operations can be performed, and the like. As a case where both post-processings are not compatible with each other, there is a case in which a result of post-processings is inappropriate although the post-processing operations can be performed.

The compatibility relation and the relation of the availability of the post-processing operations may be stored in advance as data, and the determination on whether post-processing can be performed can be made by referring to the stored relations. In addition, a sheet size for which post-processing can be performed and a sheet size that is a target for post-processing are compared with each other, and it may be determined that the post-processing cannot be performed in a case where the sheet size that is the target for post-processing deviates from the sheet size for which the post-processing can be performed and that the post-processing can be performed in a case where the sheet size that is the target for the post-processing satisfies the sheet size for which the post-processing can be performed. As the sheet size that is the target for post-processing, the feeding sheet size or the sheet size after cutting may be used.

The scanner unit 130 includes a CCD 131 that performs optical scanning and a scanner control unit 132 that controls the overall operation of the scanner unit 130. The scanner control unit 132 is connected to the control CPU 113 to be serially communicable. In addition, the CCD 131 is connected to a scanning processing unit 115 that processes image data read by the CCD 131, and the scanning processing unit 115 is connected to the DRAM control IC 111 to be controllable.

The operating unit 140 serves as both the display unit and the operating unit and includes an LCD 141 configured by a touch panel and an operating unit control unit 142 controlling the overall operation of the operating unit 140. The operating unit control unit 142 is connected to the control CPU 113 to be serially communicable.

The operating unit 140 can input output condition settings and mechanical settings of the image forming apparatus 10 such as operating control conditions, input settings of sheet information (the size and the paper type) of each feed tray, display set contents, and display desired information such as a message, and the like through the LCD 141 under the control of the control CPU 113.

A compression IC 116 compressing the image data and a decompression IC 117 decompressing compressed image data are connected to the DRAM control IC 111. A write processing unit 118 is connected to an image forming unit 15 of the printer unit 150 that includes an LD 152 and the like and processes write data used for the operation of the LD 152.

The printer unit 150 is configured by the image forming unit 15, the feed trays 11 and 12, the sheet conveying unit 13, and the like.

In addition, the printer unit 150 includes a printer control unit 158 that controls the overall operation (sheet feeding, image formation, sheet discharging, post-processing, and the like) of the printer unit 150, and the printer control unit 158 is connected to the control CPU 113. The printer control unit 158 controls the printer unit 150 by being operated in accordance with a control instruction transmitted from the control CPU 113.

Furthermore, the printer control unit 158 is connected to a reverse conveyance control unit 200 controlling the reverse conveyance apparatus 20, and the reverse conveyance control unit 200 is connected to a folding and punching control unit 300 of the folding and punching apparatus 30. In addition, the folding and punching control unit 300 is connected to a slit control unit 400 of the slit apparatus 40, and the slit control unit 400 is connected to a saddle stitching control unit 500 of the saddle stitching apparatus 50. The saddle stitching control unit 500 is connected to a side stitching control unit 600 of the side stitching apparatus 60. By employing such a configuration, the reverse conveyance apparatus 20, the folding and punching apparatus 30, the slit apparatus 40, the saddle stitching apparatus 50, and the side stitching apparatus 60 are controlled by the control CPU 113 through the printer control unit 158.

In addition, a DRAM control IC 161 of the image processing unit (print & scanner controller) 160 is connected to the PCI bus 112 to which the DRAM control IC 111 is connected as described above. In a case where the image forming apparatus 10 is used as a network printer or a network scanner, the image processing unit (print & scanner controller) 160 receives image data and the like from an external apparatus (PC) 2 or the like connected to the LAN 3 in the image forming apparatus 10 or transmits the image data acquired by the scanner unit 130 to an external apparatus (PC) 2 or the like connected to the LAN 3.

In the image processing unit (print & scanner controller) 160, an image memory 162 configured by a DRAM or the like is connected to the DRAM control IC 161. In addition, in the image processing unit (print & scanner controller) 160, the DRAM control IC 161, a controller control CPU 163 controlling the overall operation of the image processing unit (print & scanner controller) 160, and a LAN interface 165 are connected to a common bus. The LAN interface 165 is connected to the LAN 3.

Next, the basic operation of the image forming system 1 will be described.

First, the sequence of storing image data in the image forming apparatus 10 will be described.

First, a case will be described in which image data is generated by reading an image using the scanner unit 130 in the image forming apparatus 10. The scanner unit 130 optically reads an image from a document using the CCD 131. At this time, the operation of the CCD 131 is controlled by the scanner control unit 132 that receives an instruction from the control CPU 113. The scanning of the document may be performed while the document is fed by an automatic document feeder (ADF), or the scanning may be performed with the document being placed on a platen glass.

The control CPU 113 operates in accordance with a program and issues an instruction to the scanner unit 130 based on an operation (a scan instruction or a copy instruction) using the operating unit 140. Data processing is performed for the image read by the CCD 131 by the scanning processing unit 115, and the processed image data is sent to the compression IC 116 through the DRAM control IC 111 and is compressed using a predetermined method. The compressed data is stored in the image memory (DRAM) 120 through the DRAM control IC 111.

In addition, the image data is input to the image forming apparatus 10 through the LAN 3. As the image data, for example, there is image data generated by an application program or the like of an external apparatus (PC) 2 or image data generated by another image forming apparatus. The data is received by the image processing unit (print & scanner controller) 160 through the LAN 3 and the LAN interface 165 and is temporarily stored in the image memory 162 by the DRAM control IC 161. The data stored in the image memory 162 is transmitted to the DRAM control IC 111 through the PCI bus 112 and is temporarily stored in the image memory (DRAM) 120. The data stored in the image memory (DRAM) 120 is sent to the compression IC 116 through the DRAM control IC 111, is compressed, and is stored in the image memory (DRAM) 120 through the DRAM control IC 111.

In storing the image data, before or after the storage of the image data, an output setting is performed. The output setting may be performed by displaying a setting screen, on which an operating input can be made, on the operating unit 140 and receiving an operating input from an operator. In addition, even in a case where output setting items are selected in the initial setting, and a setting input is not performed by the operator, the output setting is performed based on the initial setting.

In a case where an image output is performed by the image forming apparatus 10, in other words, in a case where the image forming apparatus 10 is used as a copier or a printer, image data stored in the image memory (DRAM) 120 is transmitted to the decompression IC 117 through the DRAM control IC 111, the data is decompressed, the decompressed data is transmitted to the write processing unit 118, and the data is written into a photoreceptor charged by a charging unit using the LD 152.

In the printer unit 150, each unit is controlled by the printer control unit 158 receiving instructions from the control CPU 113. In the image forming unit 15, a latent image written into the photoreceptor is developed as a toner image by a developing unit, the toner image is transferred onto a sheet that is conveyed by the sheet conveying unit 13, by a transfer unit, and the image is fixed by the fixing device 16. The sheet on which the image has been formed is conveyed to the downstream side through the sheet conveying unit 13.

In addition, an instruction is transmitted from the printer control unit 158 to the control unit of each downstream-side apparatus. In a case where there is reversal of a sheet or a setting of post-processing in the setting of a job, a reversal instruction or a post-processing instruction is transmitted from the printer control unit 158 to a control unit of a corresponding apparatus, and the corresponding apparatus performs a reversal operation or a post-processing operation in accordance with the instruction. To an apparatus to which the reversal instruction or the post-processing instruction has not been transmitted, a sheet discharging instruction is transmitted, and the sheet is directly discharged to the downstream side, and the side stitching apparatus 60 discharges the sheet to the sheet discharging tray 63.

Next, the operating screen at the time of setting post-processing using the operating unit 140 will be described.

Figure 3:
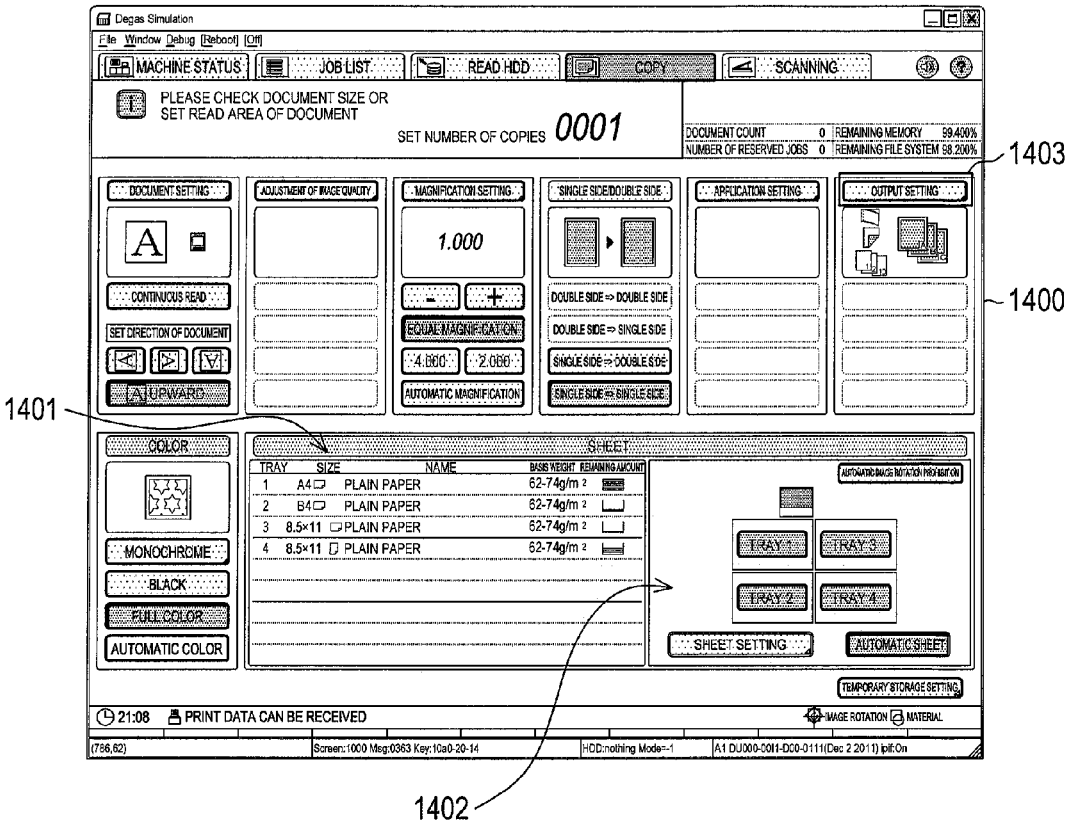
FIG. 3 is a diagram that illustrates a setting screen displayed on an operating unit.

FIG. 3 illustrates a copy setting screen 1400 displayed on the operating unit 140. On the copy setting screen 1400, various setting items are configured to be operably input. For example, a tray setting field 1401 is a field for setting sheet information of each feed tray, and settings such as a sheet size, a paper type, and a basis weight can be set for each feed tray therein. In addition, on the copy setting screen 1400, a sheet feeding selection field 1402 is arranged to be operable, and a setting of a tray from which a sheet is fed and a setting of automatic selection of a tray according to the sheet can be made. From this, the size of a sheet to be fed is determined, and the feeding sheet size is acquired by the control CPU 113.

Figure 4:
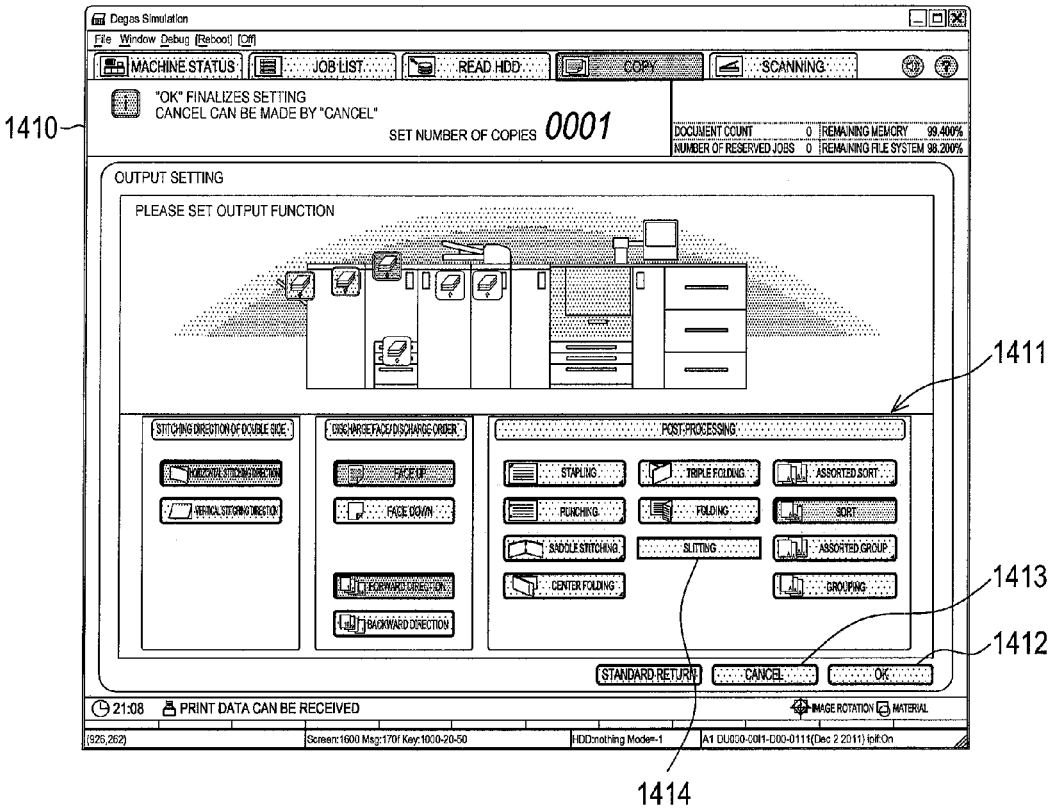
FIG. 4 is a diagram that illustrates an output setting screen displayed on the operating unit in detail.

Furthermore, on the copy setting screen 1400, an output setting button 1403 is arranged to be pressed. When the output setting button 1403 is pressed, an output setting detailed screen 1410 illustrated in FIG. 4 is displayed on the operating unit 140 to be operably input.

On the output setting detailed screen 1410, a post-processing setting field 1411 is displayed to be operably input, and settings of items of stapling, punching, saddle stitch, center folding, triple folding, folding, slit, assorted sorting, sorting, an assorted group, and a group can be set in accordance with the content of post-processing. After the setting of post-processing, by pressing an OK button 1412, the setting of post-processing is determined, and, by pressing a cancel button 1413, the set content is cancelled.

Figure 5:
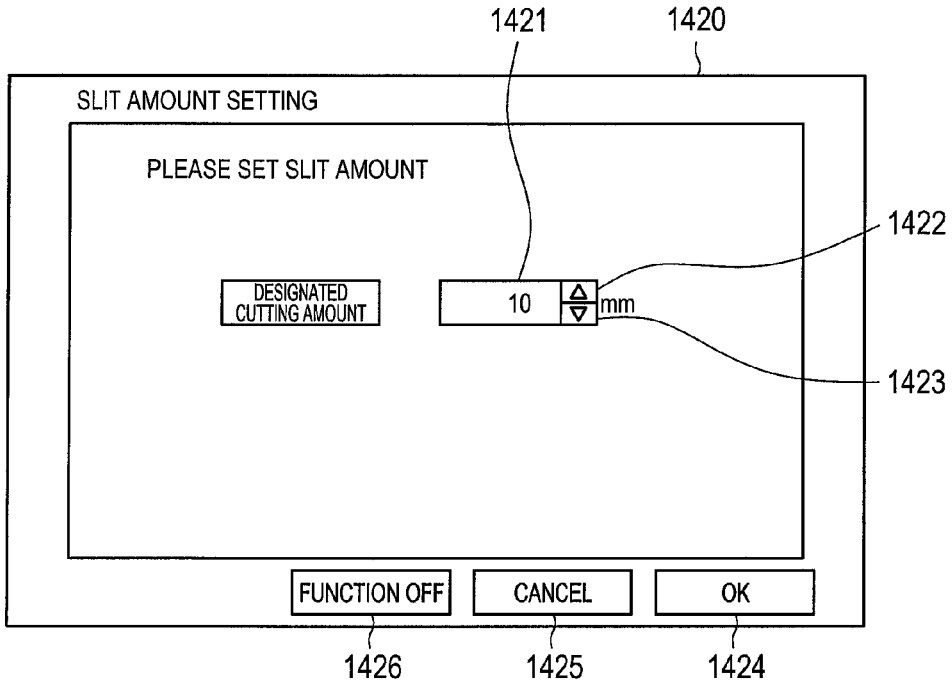
FIG. 5 is a diagram that illustrates a slit amount setting screen displayed on the operating unit.

FIG. 5 illustrates a slit amount setting screen 1420 displayed after a slit button 1414 is pressed in the post-processing setting field 1411.

On the slit amount setting screen 1420, a designated slit amount field 1421 is arranged, and a designated slit amount is displayed in the designated slit amount field 1421 in units of mm. Near the right side of the designated slit amount field 1421, an increase button 1422 and a decrease button 1423 are vertically displayed to be operable. The increase button 1422 can be used for increasing the designated slit amount in units of 1 mm, and the decrease button 1423 can be used for decreasing the designated slit amount in units of 1 mm.

When an OK button 1424 is pressed, the designated slit amount is determined, and when the cancel button 1425 is pressed, the designated slit amount is reset. On the other hand, when a function-off button 1426 is pressed, no slit function is set. By pressing the OK button 1424 or the function-off button 1426, the screen is returned to the output setting detailed screen 1410.

Figure 6:
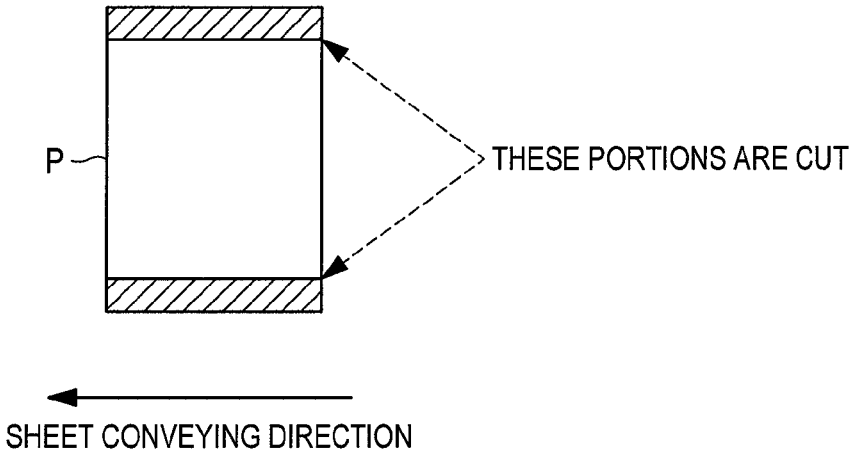
FIG. 6 is a diagram that illustrates a cut state of a sheet.

FIG. 6 illustrates cutting positions of a sheet P in the slit apparatus 40. The cutting is performed for the top and bottom sides in the main scanning direction of the sheet.

An example of the flow of the process according to setting of post-processing will be described with reference to FIGS. 7(A) to 7(C).

Figure 7:
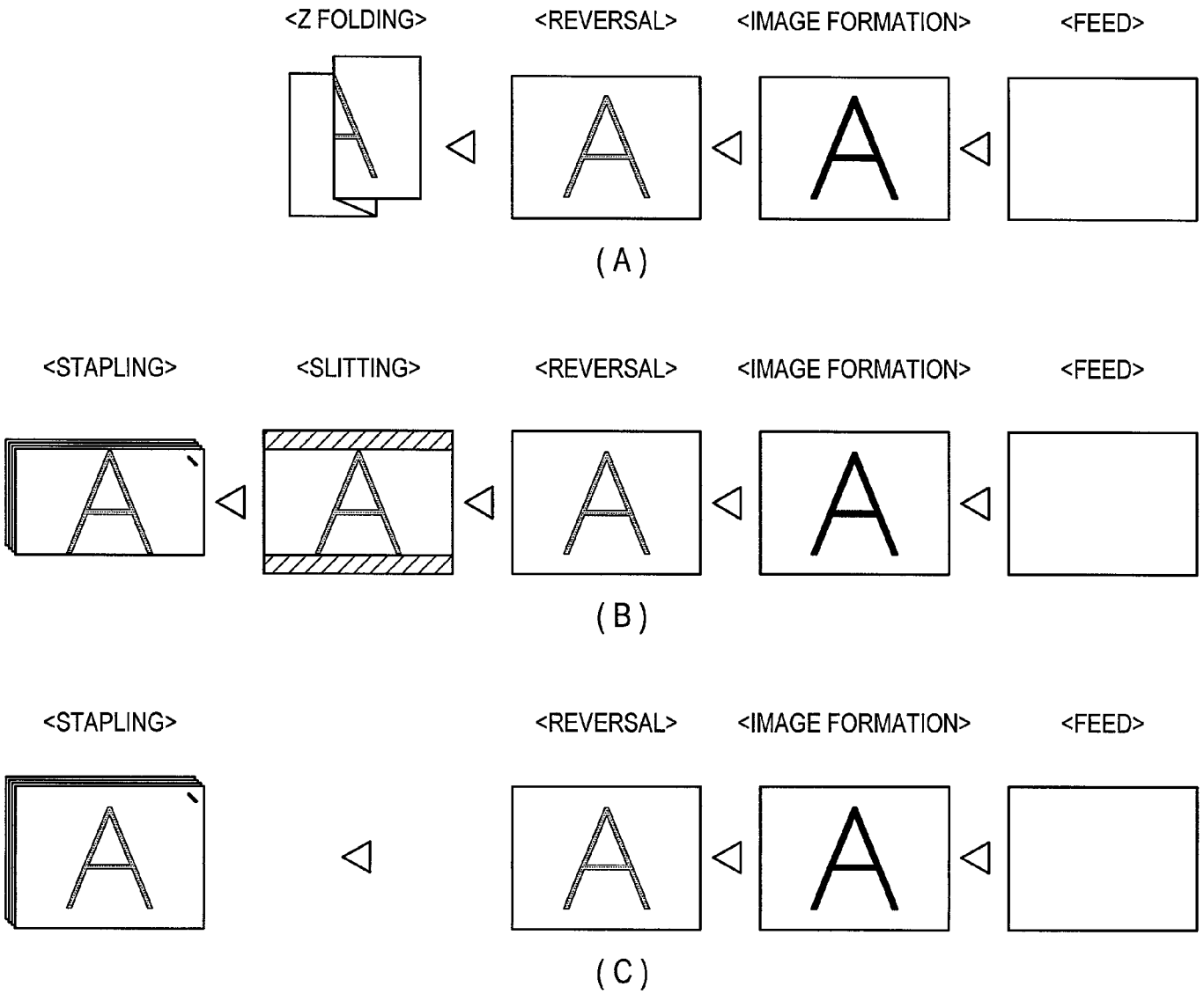
FIGS. 7(A) to 7(C) are diagrams that illustrate an example of the flow of image forming and post-processing.

FIG. 7(A) illustrates an example in which reversal and Z folding are performed for a sheet on which an image is formed. After the sheet has an image formed thereon by the image forming apparatus 10 with a size maintained to be the sheet size fed from the tray, the sheet is reversed by the reverse conveyance apparatus 20, and Z folding and a punching process are performed for the sheet by the folding and punching apparatus 30. In this example, since the post-processing of Z folding is performed on a further upstream side than the slit processing accompanying a change in the sheet size, the setting of slitting does not need to be considered in the determining whether Z folding can be performed. In such a case, it is determined whether post-processing can be performed based on whether the feeding sheet size is a sheet size for which Z folding can be performed. In a case where the post-processing can be performed, printing is started. On the other hand, in a case where the post-processing cannot be performed, printing is prohibited.

FIG. 7(B) illustrates an example in a case where there are a setting of slitting and a setting of stapling.

After a sheet has an image formed thereon by the image forming apparatus 10 with a size maintained to be the sheet size fed from the tray, the sheet is reversed by the reverse conveyance apparatus 20, and cutting for a designated slit amount, in other words, the first post-processing is performed using the slit apparatus 40. The sheet after being cut is conveyed to the saddle stitching apparatus 50 and is stapled. Since the sheet of which the top and bottom are cut by the slit apparatus 40 is used at the time of stapling, it is necessary to determine whether stapling can be performed for a sheet size after cutting.

FIG. 7(C) illustrates an example in a case where there is no setting of slitting but is a setting of stapling.

After a sheet has an image formed thereon by the image forming apparatus 10 with a size maintained to be the sheet size fed from the tray, the sheet is reversed by the reverse conveyance apparatus 20, is conveyed to the saddle stitching apparatus 50, and is stapled. In such a case, when stapling is performed, it is determined whether a stapling process can be performed based on the feeding sheet size.

As described above, a sheet size on which the determination on whether post-processing can be performed is based differs in accordance with the sequence of the post-processing.

For example, in a case where there is a setting of stapling in a state in which the slit apparatus 40 is connected before the saddle stitching apparatus 50 (a configuration in which a stapling unit of the saddle stitching apparatus 50 receives a cut sheet) and, in a case where the size for which stapling can be performed is 320 to 203 mm in the primary scanning direction, and the size of sheets housed in the feed tray is 210 mm in the primary scanning direction, a sheet size acquired by cutting the top and bottom by a total of 10 mm is 200 mm, and accordingly, stapling cannot be performed. However, post-processing can be performed without cutting.

In a case where the size of sheets housed in the fed tray is 330 mm, the size becomes 320 mm when being cut by 10 mm, and stapling can be performed (stapling cannot be performed when there is no cutting).

In a state in which the slit apparatus 40 is connected after the folding and punching apparatus 30 performing Z folding, (since the Z folding is post-processing of the former stage, the Z folding is regardless of cutting) and, in a case where there is a setting of Z folding, the size for which the Z folding can be performed is 266 to 297 mm. Accordingly, in a case where the size of sheets housed in the fed tray is less than 266 mm or more than 297 mm, the Z folding cannot be performed regardless whether there is slitting.

Next, in a case where it is determined that the post-processing cannot be performed in the post-processing determining, an error message displayed on the operating unit 140 will be described.

Figure 8:
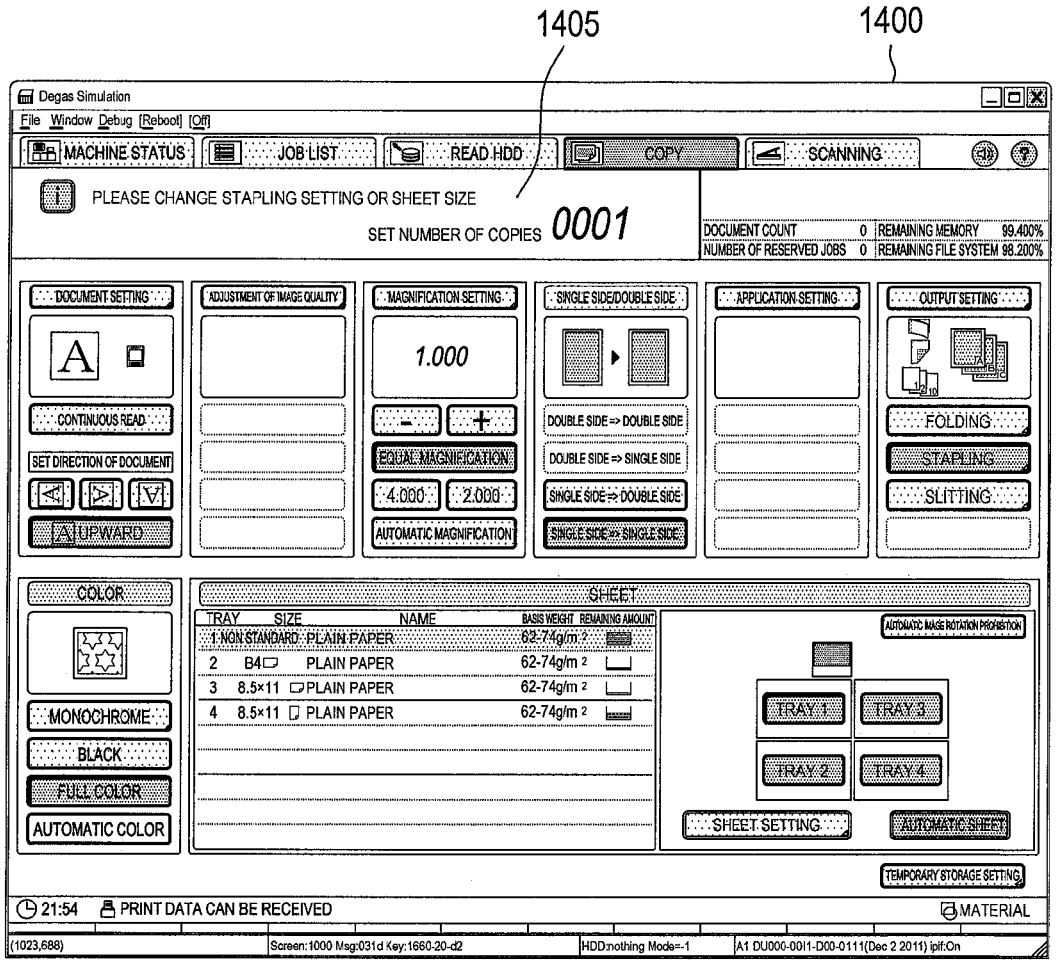
FIG. 8 is a diagram that illustrates an example of a display screen in a case where it is determined that post-processing, in which the sheet is not cut, cannot be performed.

FIG. 8 illustrates the copy setting screen 1400 in a case where there is a post-processing setting of only stapling without slitting, and it is determined that the post-processing cannot be performed. In a message filed 1405 arranged on the upper side of the copy setting screen 1400, in order to cancel the prohibition, "Please change the stapling setting or the sheet size" is displayed. In the post-processing determining, it is checked whether the feeding sheet size of sheets housed in the selected fed tray can be stapled. In the case of a size for which stapling cannot be performed, the above-described prohibition message is displayed, and it is determined that a printing operation cannot be performed. For example, it is set such that acceptance of a copy button used for starting a copy operation cannot be performed.

When the post-processing can be performed in accordance with a change in the output setting in which a setting of stapling or the sheet size changes, the prohibition of the printing operation is cancelled, and printing can be performed.

Figure 9:
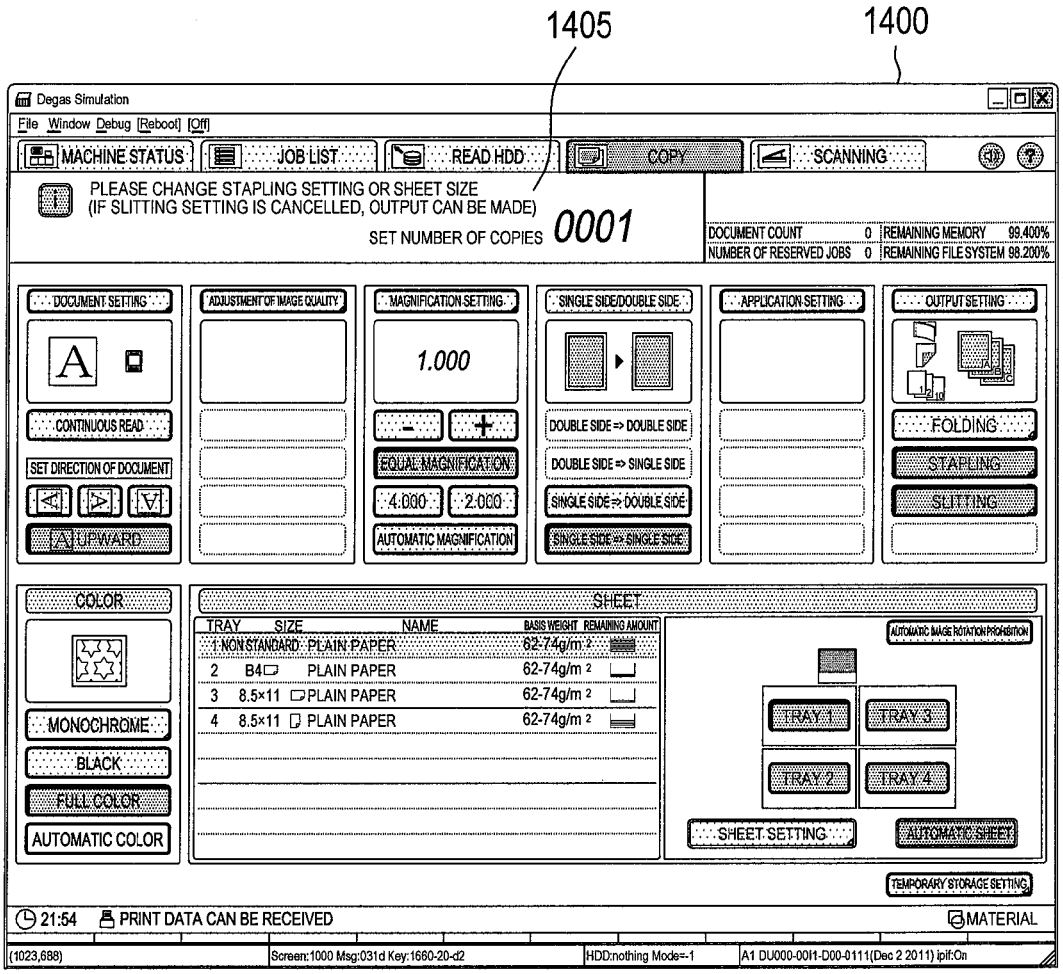
FIG. 9 is a diagram that illustrates an example of a display screen in a case where it is determined that post-processing, in which the sheet is cut, cannot be performed.

FIG. 9 illustrates the copy setting screen 1400 in a case where there is a post-processing setting in which there are slitting and stapling, and it is determined that the post-processing cannot be performed. In the message filed 1405 arranged on the upper side of the copy setting screen 1400, in order to cancel the prohibition, "Please change the stapling setting or the sheet size (when the slitting setting is cancelled, outputting can be performed)" is displayed. In the post-processing determining, it is checked whether the size of the sheet after slitting is a size for which stapling can be performed. In the case of a sheet size for which stapling cannot be performed, the above-described prohibition message is displayed, and it is determined that a printing operation cannot be performed. When the post-processing can be performed in accordance with a change in the output setting in which a setting of stapling or the sheet size changes, the state of the prohibition of the printing operation is cancelled, and printing can be performed.

In addition, in this example, in a case where the sheet having the feeding sheet size is stapled, the feeding sheet size is a size for which stapling can be performed, and, as described above, an indication representing that output can be performed when the setting of slitting is cancelled is displayed.

Figure 10:
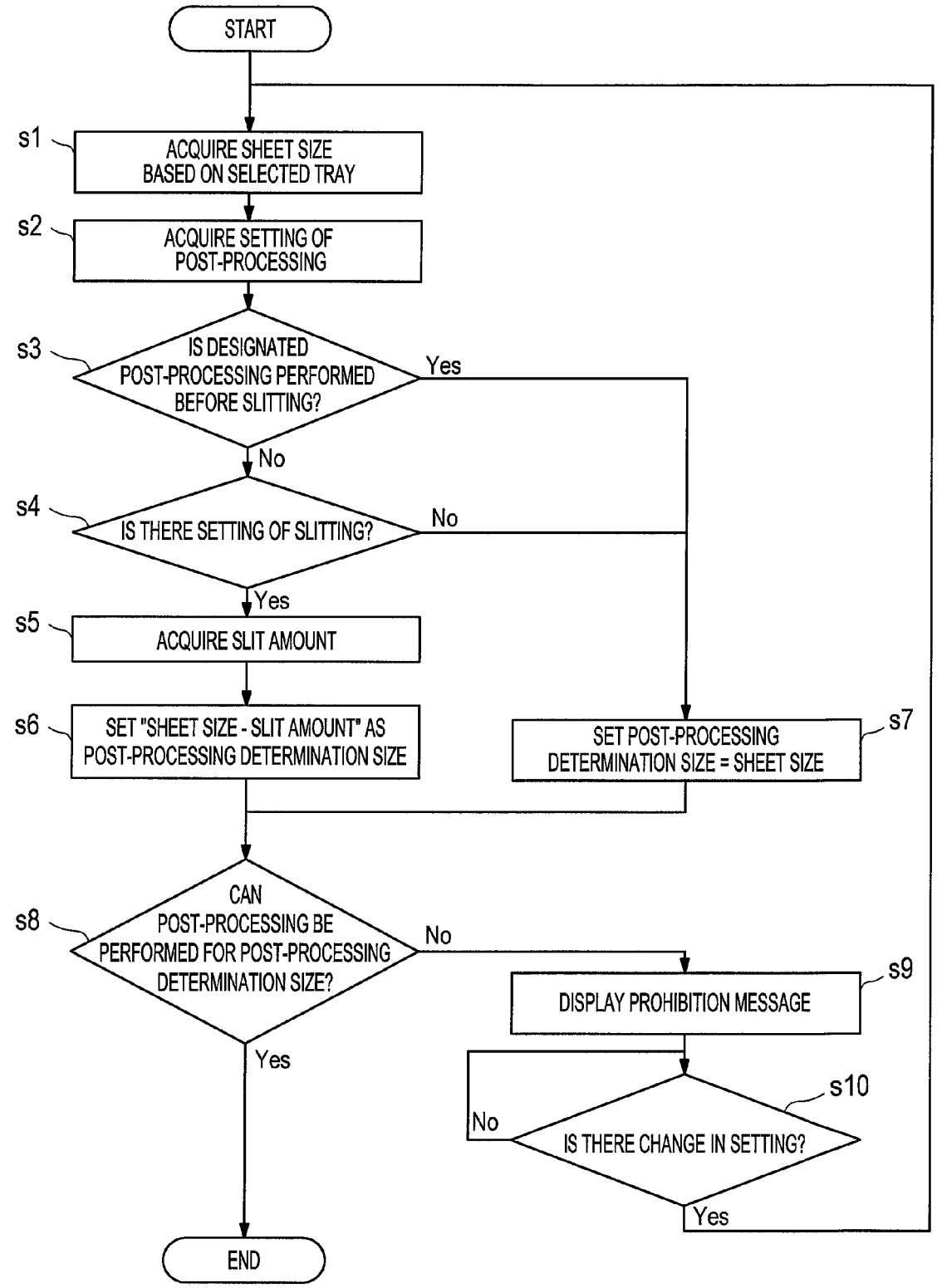
FIG. 10 is a flowchart that illustrates the process of post-processing determining.

Next, the sequence to be processed in a stage in which the setting of the post-processing and the setting of the feed tray are determined will be described with reference to a flowchart illustrated in FIG. 10. The following sequence is performed under the control of the control CPU 113.

First, a feeding sheet size is acquired based on the setting information of the selected feed tray in Step s1. Thereafter, a content of the setting of the post-processing is acquired in Step s2. It is determined whether the designated post-processing is performed before post-processing of slitting based on the acquired content of the setting of the post-processing in Step s3. In a case where the designated post-processing is performed before the processing of slitting (Yes in Step s3), the feeding sheet size is set to the post-processing determination sheet size in Step s7. On the other hand, in a case where the designated post-processing is performed after slitting (No in Step s3), it is determined whether there is a setting of the slit amount in Step s4. In a case where there is no setting of the slit amount (No in Step s4), the feeding sheet size is set to the post-processing determination sheet size in Step s7. On the other hand, in a case where there is a setting of the slit amount (Yes in Step s4), "the feeding sheet size—the slit amount" is set to the post-processing determination sheet size in Step s6.

After the post-processing determination sheet size is set (Steps s6 and s7), it is determined whether the post-processing can be performed for the post-processing determination sheet size in Step s8. For example, the determination can be made based on whether the post-processing determination sheet size is in the range of sheet sizes for which the post-processing can be performed. In a case where it is determined that the post-processing can be performed (Yes in Step s8), the process ends. On the other hand, in a case where it is determined that the post-processing cannot be performed (No in Step s8), as illustrated in FIGS. 8 and 9, a prohibition message is displayed on the operating unit 140 in Step s9, and a change of the setting using the operating unit 140 is allowed. In the change of the setting, turning-off of the slitting function or changing the setting of post-processing other than slitting, changing the slit amount for slitting, changing the feeding sheet size, and the like can be performed. When there is a change in the setting (Yes in Step s10), the process is returned to Step s1, and the same determination process is repeated.

As described above, according to the above-described embodiment, even in a case where post-processing accompanying a change in the size of the sheet is performed, a sheet size after the first post-processing accompanying a change in the size of the sheet is calculated, and it is determined whether the post-processing can be performed based on the calculated sheet size and the sheet size for which post-processing can be performed in the second post-processing, whereby the determination can be accurately made.

As above, while the embodiment of the present invention has been described, the present invention is not limited to the content of the above-described embodiment, and an appropriate change can be made therein in a range not departing from the scope of the present invention.

CROSS-REFERENCE TO RELATED APPLICATION

This application is based on Japanese Patent Application No. 2012-177890 filed with Japan Patent Office on Aug. 10, 2012, the entire content of which is hereby incorporated by reference.

What is claimed is:

1. An image forming system comprising:

a feed tray to feed a housed sheet;

a printer unit to form an image on the sheet and output the sheet;

a first post-processing unit to perform first post-processing accompanying at least a change in a sheet size and a second post-processing unit to perform second post-processing other than the first post-processing, wherein the first and second post-processing units perform post-processing of the sheet on which the image is formed; and a control unit which controls setting and performing feeding, outputting, and the post-processing of the sheet, wherein, in a case in which the first post-processing and the second post-processing are set, the control unit performs post-processing determining in which a feeding sheet size of a sheet fed from the feed tray is acquired, a sheet size after the first post-processing is calculated based on the acquired sheet size, and a determination is made as to whether the set post-processings can be performed based on the calculated sheet size and a sheet size that can be processed by the second post-processing, wherein the control unit determines an order of the second post-processing and the first post-processing in the set post-processings, applies the feeding sheet size as a sheet size of a sheet that is a target for the second post-processing in a case in which the second post-processing is performed before the first post-processing, and applies the feeding sheet size after the first post-processing as the sheet size of the sheet that is a target for the second post-processing in a case in which the second post-processing is performed after the first post-processing, and wherein the control unit controls performing the post-processing of the sheet by at least one of the first and second post-processing units based on a result of the post-processing determining.

2. The image forming system according to claim 1, wherein the control unit determines whether the post-processings can be processed based on whether the second post-processing and the first post-processing are compatible or whether the first post-processing unit and the second post-processing unit are operable.

3. The image forming system according to claim 1, wherein, in a case in which the sheet that is a target for the second post-processing in the setting of the post-processing is a sheet after the first post-processing, the control unit performs a comparison between the calculated sheet size and the sheet size that can be processed in the second post-processing, and performs the post-processing determining based on a result of the comparison.

4. The image forming system according to claim 1, wherein the first post-processing unit changes the sheet size by performing a cutting process of a target sheet in at least one direction of a primary scanning direction and a sub-scanning direction as the first post-processing and discharges the sheet downstream.

5. The image forming system according to claim 1, wherein, in a case in which it is determined that the processing cannot be performed in the post-processing determining, the control unit enables a change of the setting of the outputting and performs the post-processing determining again based on a changed setting when the setting is changed.

6. The image forming system according to claim 5, further comprising an operating unit that is controllable by the control unit and is operable to perform an operation of changing the setting of the outputting.

7. The image forming system according to claim 5, wherein the control unit enables at least one of a change of the setting of the post-processings and a change of the feeding sheet size as the change of the setting of the outputting.

8. The image forming system according to claim 7, wherein the first post-processing unit changes the sheet size by performing a cutting process of a target sheet in at least one direction of a primary scanning direction and a sub-scanning direction as the first post-processing and discharges the sheet downstream, and wherein the control unit is operable to change a setting of a cutting amount of the cutting process as the change of the setting of the post-processing.

9. The image forming system according to claim 1, wherein, in a case in which it is determined that the post-processings cannot be performed in the post-processing determining, the control unit performs a print start prohibiting process.

10. The image forming system according to claim 9, wherein the print start prohibiting process includes at least displaying a message prohibiting a print start.

11. The image forming system according to claim 10, further comprising a display unit that is controllable by the control unit and that displays the message.

12. A post-processing method for performing post-processing for a sheet on which an image is formed under control of a control unit of an image forming system, the post-processing method comprising:

performing, by the control unit, post-processing determining in which a feeding sheet size of a sheet for the post-processing is acquired, a sheet size after first post-processing is calculated based on the acquired feeding sheet size, and a determination is made as to whether the first post-processing and second post-processing can be performed based on the calculated sheet size and a sheet size that can be processed by the second post-processing in a case in which at least the first post-processing accompanying a change in the sheet size and the second post-processing other than the first post-processing are to be performed, wherein in the post-processing determining, the control unit determines an order of the first post-processing and the second post-processing, applies the feeding sheet size as a sheet size of a sheet that is a target for the second post-processing in a case in which the second post-processing is to be performed before the first post-processing, and applies the sheet size after the first post-processing as the sheet size of the sheet that is a target for the second post-processing in a case in which the second post-processing is to be performed after the first post-processing; and controlling, by the control unit, performing of at least one of the first and second post-processings based on a result of the post-processing determining.

13. The post-processing method according to claim 12, wherein the post-processing determining determines whether the post-processings can be processed based on whether the second post-processing and the first post-processing are compatible or whether units which perform the first post-processing and the second post-processing are operable.

14. The post-processing method according to claim 12, wherein, in a case in which the sheet that is a target for the second post-processing is a sheet after the first post-processing, a comparison is made between the calculated sheet size and the sheet size that can be processed in the second post-processing, and the post-processing determining is performed based on a result of the comparison.

15. The post-processing method according to claim 12, wherein, in the first post-processing, the sheet size changes by performing a cutting process of a target sheet in at least one direction of a primary scanning direction and a sub-scanning direction, and the sheet is discharged downstream.

16. The post-processing method according to claim 12, wherein, in a case in which it is determined that the processing cannot be performed in the post-processing determining, when the setting of the outputting is changed, the post-processing determining is performed again based on the changed setting.

17. The post-processing method according to claim 16, wherein the change of the setting of the outputting is at least one of a change of the setting of the post-processings and a change of the feeding sheet size.

18. The post-processing method according to claim 17, wherein, in the first post-processing, the sheet size is changed by performing a cutting process of a target sheet in at least one direction of a primary scanning direction and a sub-scanning direction, and the sheet is discharged downstream, and wherein a setting of a cutting amount of the cutting process is changeable.

* * * * *